US010424258B2

(12) United States Patent
Endo

(10) Patent No.: US 10,424,258 B2
(45) Date of Patent: Sep. 24, 2019

(54) LIQUID CRYSTAL DISPLAY DEVICE AND A METHOD FOR DRIVING THEREOF

(71) Applicant: Panasonic Liquid Crystal Display Co., Ltd., Hyogo (JP)

(72) Inventor: Kenta Endo, Hyogo (JP)

(73) Assignee: PANASONIC LIQUID CRYSTAL DISPLAY CO., LTD., Hyogo (JP)

( * ) Notice: Subject to any disclaimer, the term of this patent is extended or adjusted under 35 U.S.C. 154(b) by 240 days.

(21) Appl. No.: 15/475,176

(22) Filed: Mar. 31, 2017

(65) Prior Publication Data

US 2018/0286329 A1 Oct. 4, 2018

(51) Int. Cl.
*G09G 3/36* (2006.01)

(52) U.S. Cl.
CPC ..... *G09G 3/3614* (2013.01); *G09G 3/3688* (2013.01); *G09G 2300/0823* (2013.01); *G09G 2320/041* (2013.01)

(58) Field of Classification Search
CPC ..... G09G 3/3614; G09G 3/3688; G09G 2300/0823; G09G 2320/041
See application file for complete search history.

(56) References Cited

U.S. PATENT DOCUMENTS

2010/0134392 A1* 6/2010 Sumi ..... G09G 3/3648 345/87
2011/0316823 A1* 12/2011 Otani ..... G09G 3/3688 345/204
2013/0076706 A1 3/2013 Andou et al.
2015/0235604 A1 8/2015 Andou et al.

* cited by examiner

*Primary Examiner* — Robert J Michaud
(74) *Attorney, Agent, or Firm* — HEA Law PLLC

(57) ABSTRACT

A liquid crystal display (LCD) may be described. The LCD can include a source driver; data lines electrically connected to the source driver; switches; connecting lines; a charge share line connecting each switch; a charge share connecting signal emitter that turns each switch on or off via the charge share line; and a thermal sensor that is secured to the LCD apparatus and detects a temperature. Each data line electrically connects to at least one of an LCD pixel, each connecting line electrically connects each pair of the data lines and each connecting line is switched on or off by each switch, the charge share connecting signal emitter turns each switch on and off in each horizontal period when the thermal sensor detects that the temperature is lower than a first predetermined temperature, and the source driver inputs a writing voltage to the plurality of data lines by column inversion.

12 Claims, 7 Drawing Sheets

LIQUID CRYSTAL DISPLAY DEVICE AND A METHOD FOR DRIVING THEREOF

BACKGROUND

Liquid crystal displays (LCDs) are widely utilized in different environments. LCDs are commonly used in home or office environments, smartphones, handheld devices, light and heavy machinery, and automobiles. As a result, LCDs are subjected to a variety of ambient conditions, such as significant fluctuations in temperature.

When ambient temperatures drop below zero Celsius, the performance and quality of image on an LCD are often impacted. For example, at a temperature of −20 Celsius, the response time of the liquid crystals has become so slow that an image cannot be properly displayed on an LCD.

As LCDs are used in many situations where the temperature is often well below freezing, the effectiveness of LCDs and the devices or equipment they are associated with is critical for users. An LCD that is nonfunctional or not functioning at an optimal level may render devices and equipment associated with LCDs inoperable or even constitute a safety hazard until the LCDs or the ambient environment become warmer. Thus, an LCD that can function properly in cold ambient temperatures is desired.

SUMMARY

According to at least one exemplary embodiment, a liquid crystal display (LCD) apparatus may be described. The LCD can include a source driver; a plurality of data lines electrically connected to the source driver; a plurality of switches; a plurality of connecting lines; a charge share line connecting each switch of the plurality of switches; a charge share connecting signal emitter that turns each switch of the plurality of switches on or off via the charge share line; and a thermal sensor that is secured to the LCD apparatus and detects a temperature. In the exemplary embodiment, each data line of the plurality of data lines electrically connects to at least one of an LCD pixel among a plurality of LCD pixels, each connecting line of the plurality of connecting lines electrically connects each pair of the data lines and each connecting line is switched on or off by each switch of the plurality of switches, the charge share connecting signal emitter turns each switch of the plurality of switches on and off in each horizontal period when the thermal sensor detects that the temperature is lower than a first predetermined temperature, and wherein the source driver inputs a writing voltage to the plurality of data lines by column inversion.

In another exemplary embodiment, LCD apparatus may also be described. The LCD may have a source driver; a plurality of data lines electrically connected to the source driver; a plurality of switches; a plurality of connecting lines; a charge share line connecting each switch of the plurality of switches; a charge share connecting signal emitter that turns each switch of the plurality of switches on or off via the charge share line; and a thermal sensor that is secured to the LCD apparatus and detects a temperature. In this exemplary embodiment, each data line of the plurality of data lines electrically connects to at least one of an LCD pixel among a plurality of LCD pixels, each connecting line of the plurality of connecting lines electrically connects each pair of the data lines and each connecting line is switched on or off by each switch of the plurality of switches, and the charge share connecting signal emitter turns each switch of the plurality of switches on and off in a first horizontal period when the thermal sensor detects that the temperature is lower than a first predetermined temperature, and the source driver inputs a same polarity of writing voltage to each data line of the plurality of data lines between the first horizontal period and a second horizontal period prior to the first horizontal period.

In still another exemplary embodiment, a method for driving an LCD may be described. The method can include inputting, by a source driver, a writing voltage to a plurality of LCD pixels via a plurality of data lines by column inversion; detecting, by a thermal sensor secured to the LCD, an temperature; and turning on and off, in each horizontal period by a charge share connecting signal emitter, a plurality of switches via a charge share line when the thermal sensor detects that the temperature is lower than a first predetermined temperature. Additionally, in the exemplary method, the charge share line electrically connects each switch of the plurality of switches, and each pair of the data lines are electrically connected by each connecting line of a plurality of connecting lines and each connecting line is switched on or off by the each switch of the plurality of switches.

BRIEF DESCRIPTION OF THE FIGURES

Advantages of embodiments of the present disclosure will be apparent from the following detailed description of the exemplary embodiments thereof, which description should be considered in conjunction with the accompanying drawings in which like numerals indicate like elements, in which.

DETAILED DESCRIPTION

Aspects of the disclosure are disclosed in the following description and related drawings directed to specific embodiments of the disclosure. Alternate embodiments may be devised without departing from the spirit or the scope of the invention. Additionally, well-known elements of exemplary embodiments of the disclosure will not be described in detail or will be omitted so as not to obscure the relevant details of the invention. Further, to facilitate an understanding of the description discussion of several terms used herein follows.

As used herein, the word "exemplary" means "serving as an example, instance or illustration." The embodiments described herein are not limiting, but rather are exemplary only. It should be understood that the described embodiments are not necessarily to be construed as preferred or advantageous over other embodiments. Moreover, the terms "embodiments of the invention", "embodiments" or "invention" do not require that all embodiments of the invention include the discussed feature, advantage or mode of operation.

Further, many of the embodiments described herein are described in terms of sequences of actions to be performed by, for example, elements of a computing device. It should be recognized by those skilled in the art that the various sequences of actions described herein can be performed by specific circuits (e.g. application specific integrated circuits (ASICs)) and/or by program instructions executed by at least one processor. Additionally, the sequence of actions described herein can be embodied entirely within any form of computer-readable storage medium such that execution of the sequence of actions enables the at least one processor to perform the functionality described herein. Furthermore, the sequence of actions described herein can be embodied in a combination of hardware and software. Thus, the various aspects of the present invention may be embodied in a number of different forms, all of which have been contemplated to be within the scope of the claimed subject matter. In addition, for each of the embodiments described herein, the corresponding form of any such embodiment may be described herein as, for example, "a computer configured to" perform the described action.

According to an exemplary embodiment, and referring to the Figures generally, a liquid crystal display (LCD) device and a method for driving an LCD may be provided. According to one exemplary embodiment, an LCD may be able to determine the ambient temperature and selectively drive pixels to rapidly warm the LCD to a desired temperature. In particular, this embodiment may increase the movement of the liquid crystal molecules by driving the source driver frequently with a charge share connecting mechanism. Thus, the exemplary embodiments may enable an image to be displayed properly in the LCD even under a low temperature.

Figure 1:
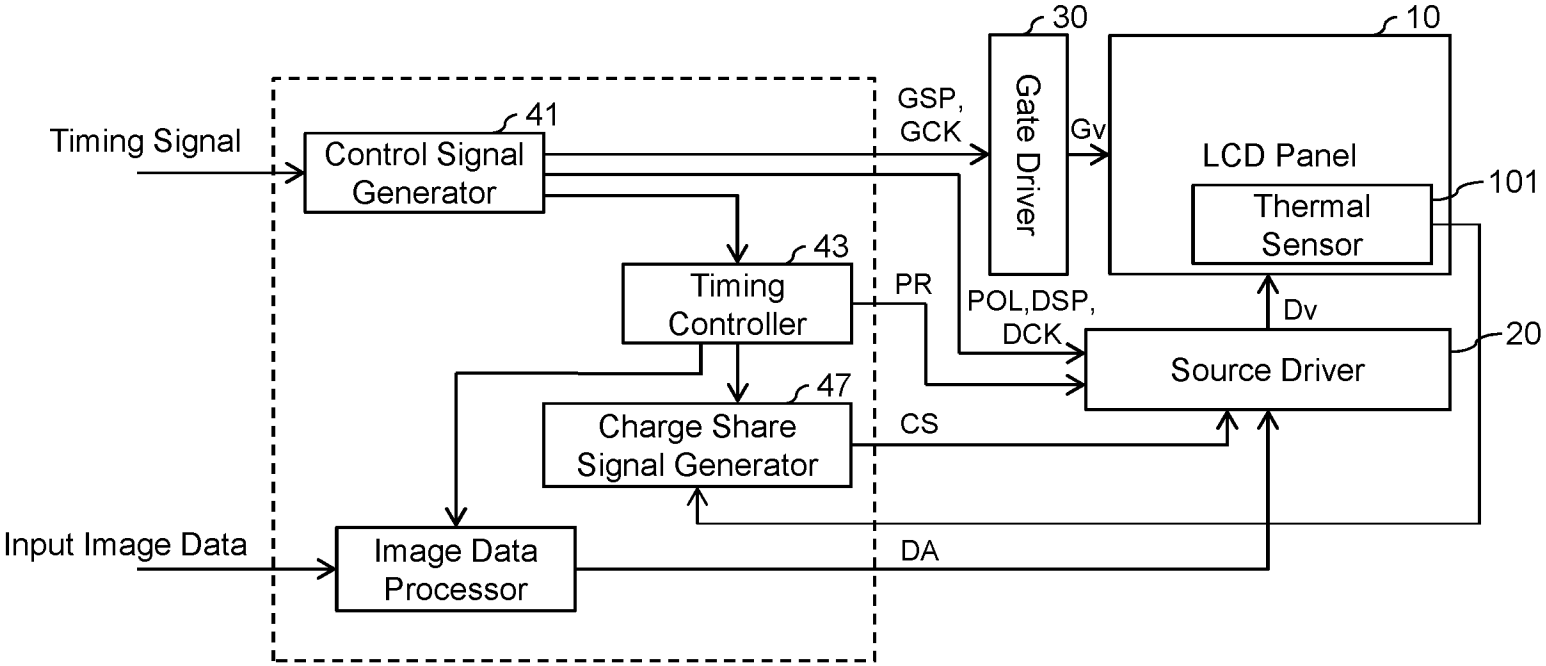
FIG. 1 is a block diagram showing a configuration of a liquid crystal display driving system according to an exemplary embodiment of the present disclosure.

Turing to exemplary FIG. 1, FIG. 1 shows an LCD driving system according to an exemplary embodiment. In an exemplary embodiment, the LCD driving system includes the gate driver 30 and the source driver 20 which drive the pixels of the LCD panel 10. The source driver 20 applies a data voltage (the voltage to write an image on the pixels) to the LCD pixels via a data line. With reference to exemplary FIG. 2, the pixels may be arranged in matrix where the pixels may be connected via the data line 21 vertically and connected via a gate line 31 horizontally. The LCD pixels which are connected vertically by the data line 21 are charged in the order of the data line direction. Also, each pixel is charged during each corresponding horizontal period which is in sync with a gate voltage (the voltage to turn on the gate of the pixel). The gate driver 30 applies the gate voltage to each pixel which is connected via each gate line 31.

Referring back to FIG. 1, the sync of the horizontal period is controlled by the timing controller 43. The thermal sensor 101 is secured to the LCD driving system to detect the temperature of the LCD and the thermal sensor 101 sends its temperature information to the charge share signal generator 47. According to an exemplary embodiment, the charge share signal generator 47 may also be known as a charge share connecting signal emitter. With the temperature information of the thermal sensor 101 and the timing information of the timing controller 43, the charge share signal generator 47 controls charge share connections which are for charge sharing between a pair of the data lines. The charge sharing allows for the heating of the LCD panel 10 in desired situations. The heating mechanism and method are discussed in detail below.

Figure 2:
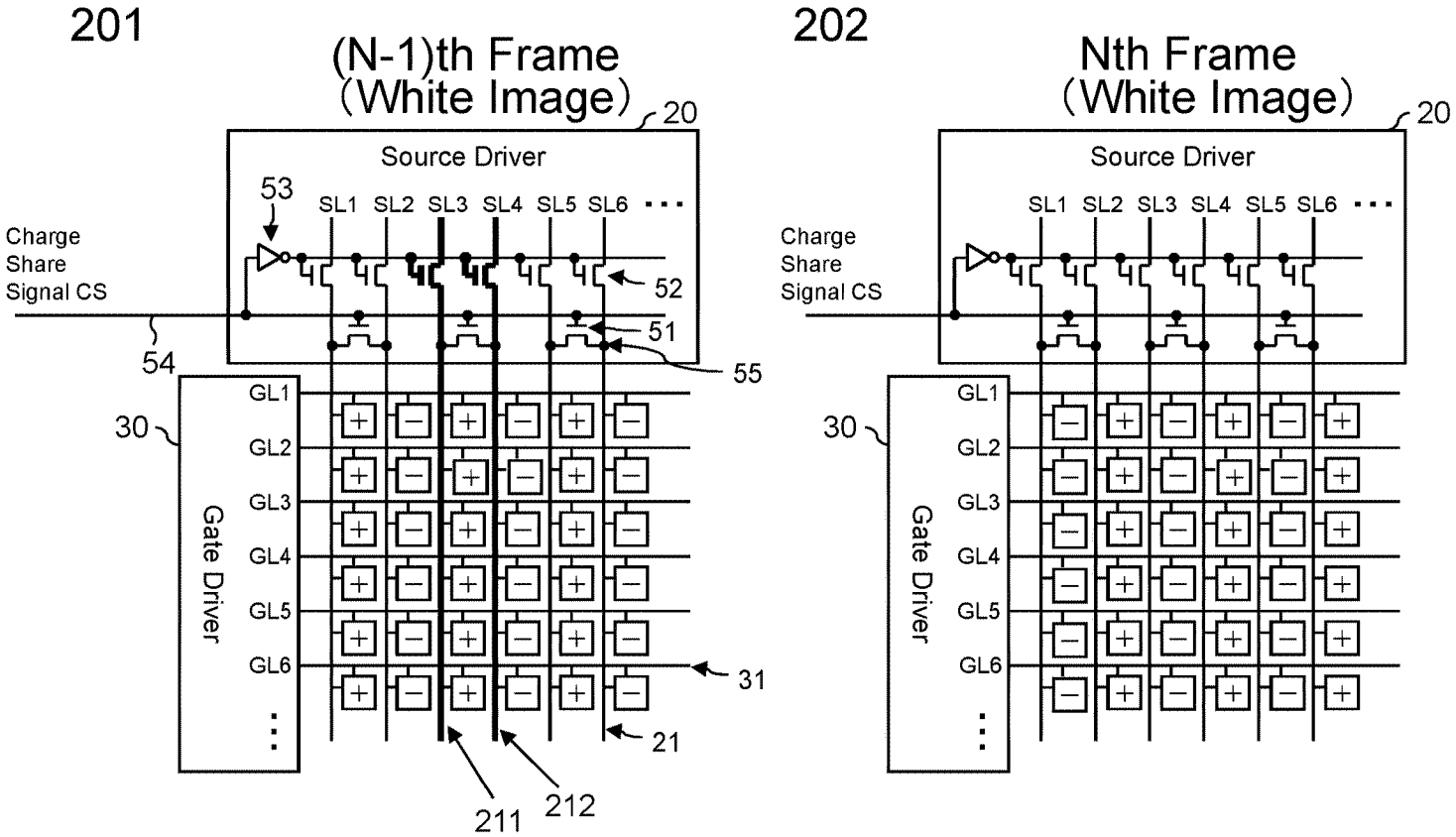
FIG. 2 is a schematic diagram showing an arrangement of a charge share connection and the polarity of an applied voltage to pixels in a certain frame according to an exemplary embodiment of the present disclosure.

Turing to exemplary FIG. 2, FIG. 2 shows a configuration of the charge share connections. As described above, the pixels are arranged as a matrix. According to an exemplary embodiment, as shown in FIG. 2, the polarity of an applied voltage to pixels is a column inversion. Each pair of the data lines comprises a first data line 211 and a second data line 212. The source driver 20 applies the writing voltages so as to make the polarities of the writing voltages in the first data line 211 and the second data line 212 different from each other. Also, the source driver 20 changes the polarities of the first and second data line in each frame. Accordingly, (N−1)th frame 201 and Nth frame 202 have different polarities in column inversion as shown in FIG. 2. In this manner, the column inversion of the pixel voltages is changed in each frame.

Figure 6:
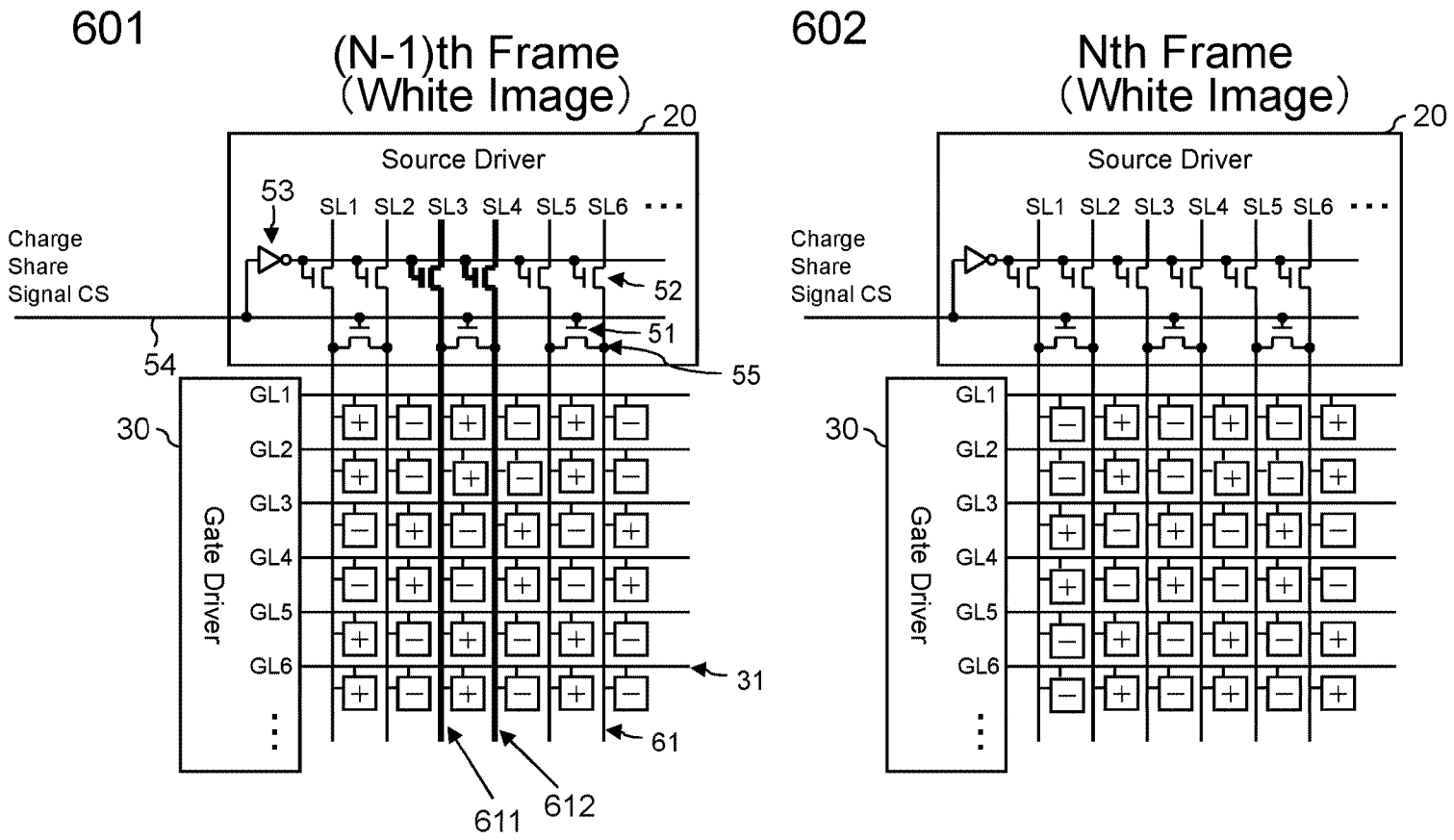
FIG. 6 is a schematic diagram showing an arrangement of a charge share connection and the polarity of an applied voltage to pixels in a certain frame according to an exemplary embodiment of the present disclosure.

In another exemplary embodiment, the polarities of the pixels' pattern are not limited to the column inversion, but may be vary in other manners, such as a dot inversion (not shown) or two dots inversion (refer to FIG. 6). For example, the dot inversion can be arranged if the source driver changes the polarities of the writing voltages via the data lines in each horizontal period. In a similar manner, the two dots inversion is arranged if the source driver changes the polarity of the writing voltages in every two horizontal periods. It is envisioned that such methodologies may be used in the exemplary embodiments described herein, as desired.

According to an exemplary embodiment, as shown in FIG. 2, each pair of the data lines is connected by each connecting line 55. In particular, the first data line 211 and the second data line 212 in each pair of the data lines are connected via the connecting lines 55. Also, each connecting line 55 may be turned on and off by each switch 51. The charge share signal generator 47 (the charge share connecting signal emitter) is connected to the switches 51 via the charge share line 54, and the switches 51 are connected to each other via the charge share line 54. The charge share signal generator 47 may turn the switches 51 on or off depending on the temperature information of the thermal sensor 101 and the timing information of the timing controller 43.

Still referring to exemplary FIG. 2, the charge share line 54 is connected to an inverter 53, and then connected to each data line 21 via each disconnecting switch 52. When the charge share signal generator 47 applies a turn off voltage (the charge share signal) to switches 51, the turn off voltage is inverted as a turn on voltage and applied to the disconnecting switches 52. Thus, if the charge share signal generator 47 turns off the switches 51, the connections between the source driver 20 and the data lines 21 are on (connected) by the disconnecting switches 52 and the connection between the first data line 211 and the second data line 212 of each pair of data lines is off (disconnected). On the other hand, when the charge share signal generator 47 applies the turn on voltage (the charge share signal) to switches 51, the turn on voltage is inverted as the turn off voltage and is then applied to the disconnecting switches 52. Thus, if the charge share signal generator 47 turns on the switches 51, the connections between the source driver 20 and the data lines 21 are off (disconnected) by the disconnecting switches 52 and the connection between the first data line 211 and the second data line 212 of each pair of data lines 21 is on (connected).

Figure 3:
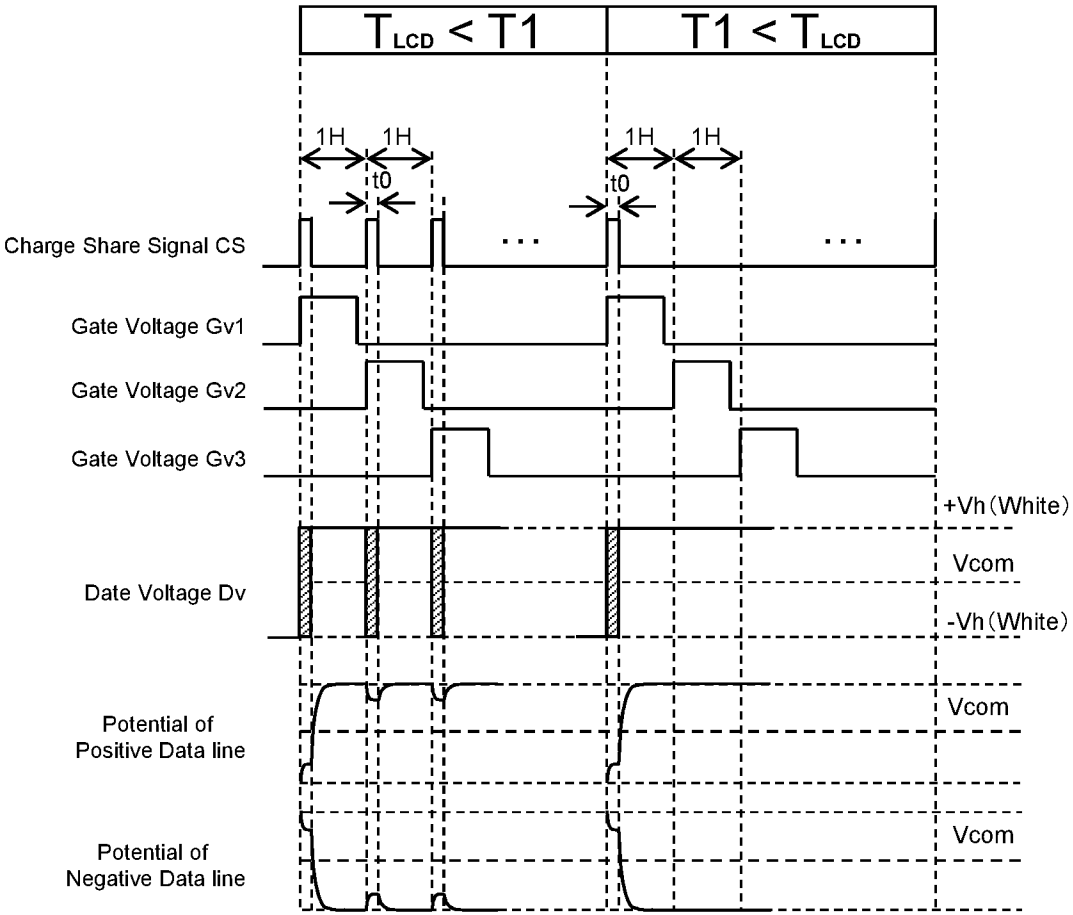
FIG. 3 is a timing chart showing timing of each signal according to an exemplary embodiment.
Figure 4:
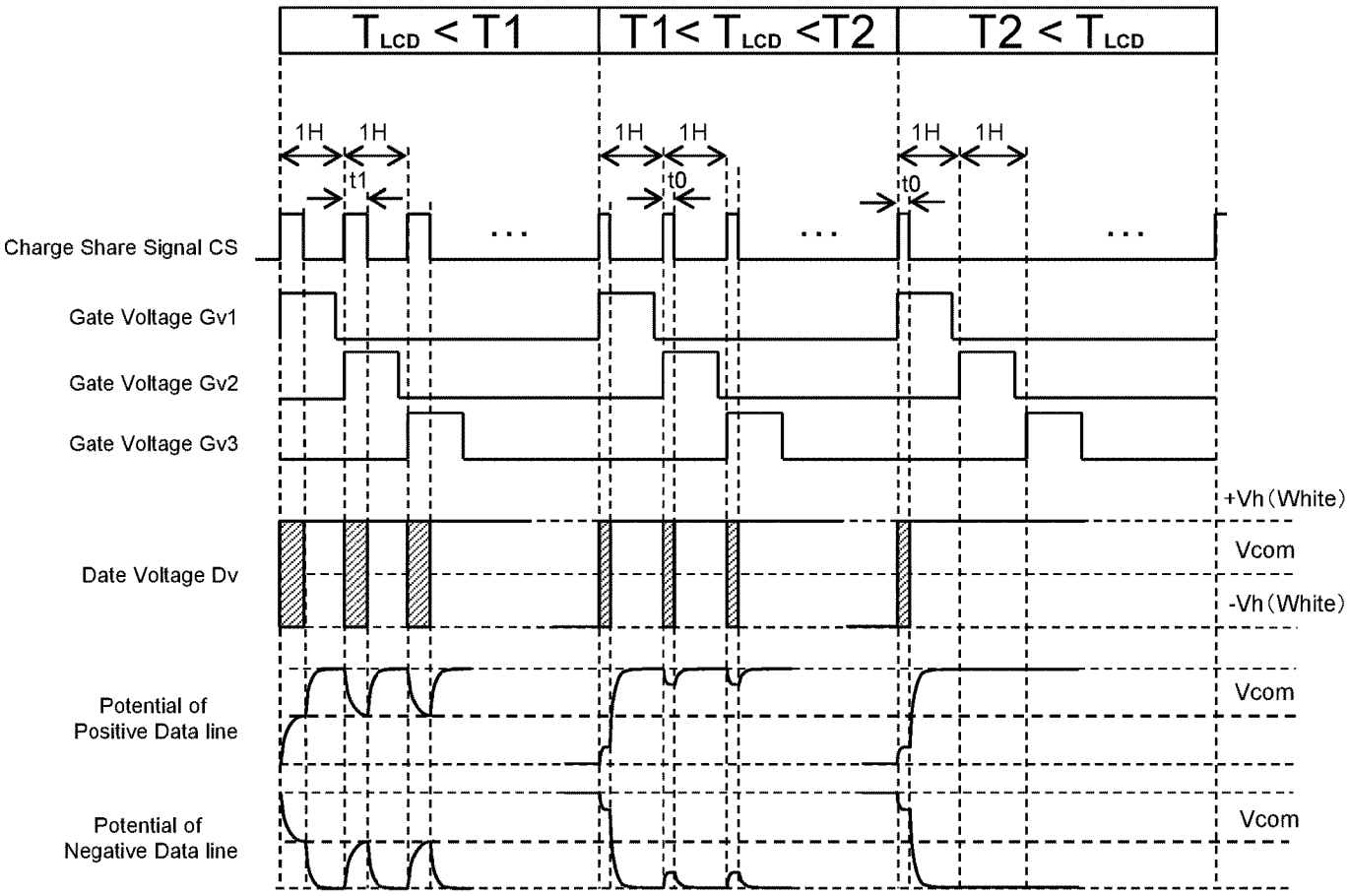
FIG. 4 is a timing chart showing a timing of each signal according to another exemplary embodiment.
Figure 5:
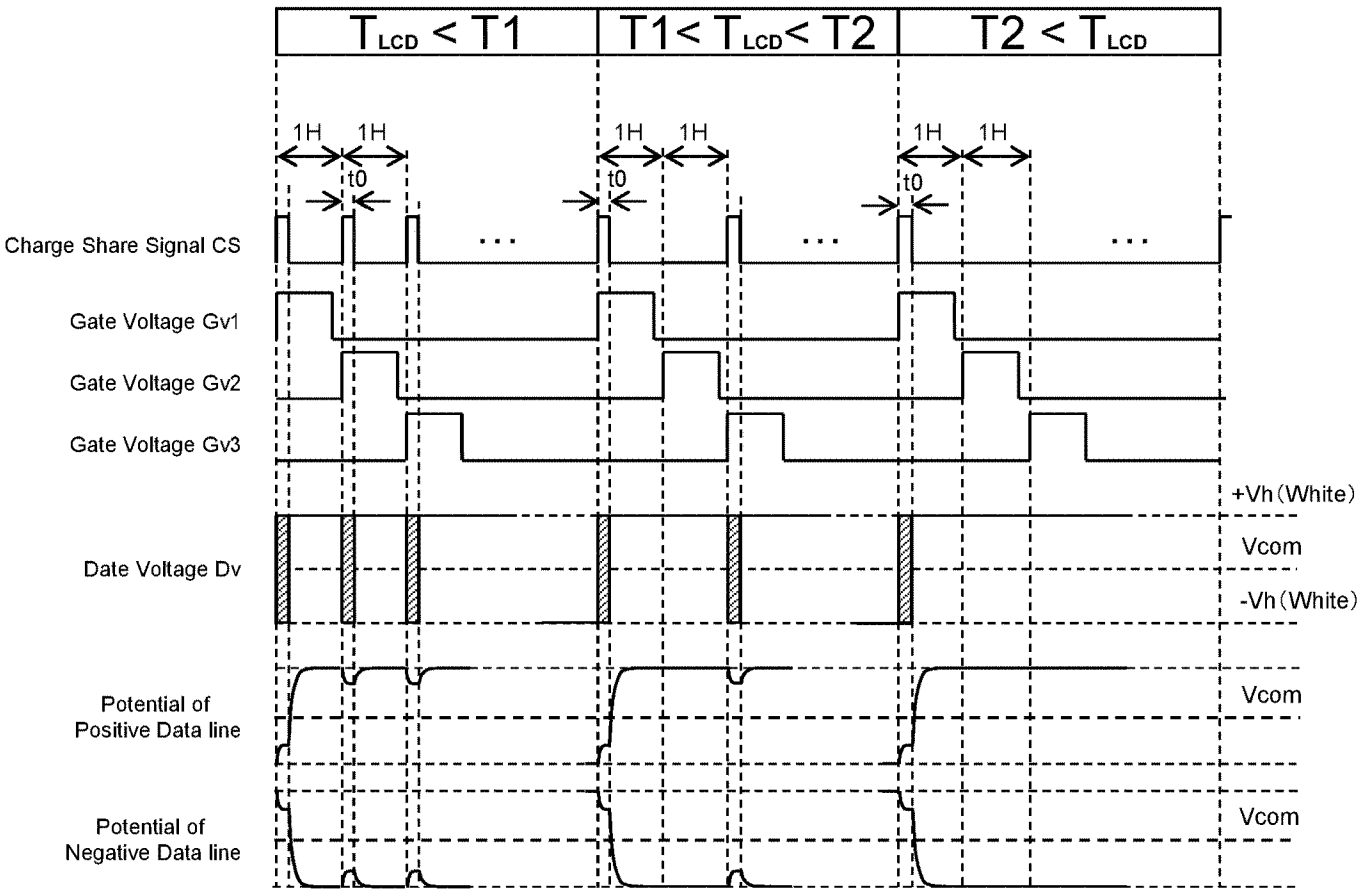
FIG. 5 is a timing chart showing a timing of each signal according to another exemplary embodiment.

Turing to exemplary FIGS. 3, 4 and 5, these figures show three exemplary embodiments of an LCD with a thermal sensor, such as thermal sensor 101 of FIG. 1. In FIG. 3, the thermal sensor checks if the current temperature ($T_{LCD}$) is lower than a predetermined temperature (T1). If the temperature ($T_{LCD}$) is lower than the predetermined temperature (T1), the thermal sensor sends a signal to the charge share signal generator, for example charge share signal generator 47 of FIG. 1. Then, the charge share signal generator inputs the charge share signal to turn on the switches (e.g. switches 51 of FIG. 2) at the timing of the horizontal period (1H) which is instructed by the timing controller. According to a first exemplary embodiment, as shown in FIG. 3, the charge share signal generator 47 turns on the switches 51 during a certain period (t0) in each horizontal period (1H) if the temperature ($T_{LCD}$) is lower than the predetermined temperature (T1), whereby a temperature of the LCD panel 10 can be increased because the source driver 20 input a writing voltage on the data lines 21. Herein, the source driver 20 inputs a white writing voltage corresponding to a white image to the data lines 21 when the LCD panel 10 is a normally black type irrespective of an external input image data. And the source driver 20 inputs a black writing voltage corresponding to a black image to the data lines 21 when the LCD panel 10 is a normally white type irrespective of an external input image data. The white writing voltage is the maximum voltage or the minimum voltage when the LCD panel 10 is the normally black type. The black writing voltage is the maximum voltage or the minimum voltage when the LCD panel 10 is the normally white type. After the charge share signal generator 47 inputs the charge share signal to turn on the switches 51, the positively charged data line 211 and the negatively charged data line 212 share their charge and come close to the common potential. After the charge share signal generator 47 stops the charge share signal to turn off the switches 51, the source driver 20 recharges a writing voltage to each data lines 21 again, which imposes some burden on the source driver. That is why the source driver 20 emits heat and makes the LCD panel 20 warmer.

If the temperature ($T_{LCD}$) is higher than the predetermined temperature (T1), the charge share signal generator 47 turns off the switches 51, except a first horizontal period every frame because the source driver 20 changes the polarities of each data line 21 in each frame. Therefore, the charge share connecting signal generator 47 turns on each switch 51 only one time in one frame.

Exemplary FIG. 4 shows another exemplary embodiment. As shown in FIG. 4, the temperature range may be divided by a first predetermined temperature (T1) and a second predetermined temperature (T2). Thus, there are three cases: (i) the temperature is lower than the first predetermined temperature ($T_{LCD}$<T1); (ii) the temperature is higher than the first predetermined temperature, but lower than the second predetermined temperature (T1<$T_{LCD}$<T2); and (iii) the temperature is higher than the second temperature (T2<$T_{LCD}$). Also, in another exemplary embodiment, the amount of heat generated may be varied by changing a charge share period (t0 and t1) during which the switches 51 are turned on. For example, as shown in FIG. 4, if the temperature ($T_{LCD}$) is lower than the first temperature (T1), the switches 51 are turned on during a relatively long period (t1). If the temperature ($T_{LCD}$) is higher than the first temperature (T1), but lower than the second temperature (T2), the switches 51 are turned on during a relatively short period (t0). If the temperature ($T_{LCD}$) is higher than the second temperature (T2), the switches 51 are not turned on. As the switches 51 are turned on during a longer period, the source driver 20 recharges a writing voltage to each data lines 21 again for a longer time, which imposes more burden on the source driver 20 and causes the source driver 20 to emit more heat.

In still another exemplary embodiment, the amount of heat generated may be controlled by the frequency of the turn on signal (also known as the charging share signal). For example, as shown in FIG. 5, the switches 51 are turned on during the same period (t0) in every temperature range, but the switches 51 are turned on in every second horizontal period (1H) if the temperature ($T_{LCD}$) is lower than the second temperature (T2) and higher than the first temperature (T1). On the other hand, if the temperature ($T_{LCD}$) is lower than the first temperature (T1), the switches 51 are turned on in each horizontal period (1H). In this manner, the LCD may be less heated as the temperature is higher or as the temperature rises.

Turing to exemplary FIG. 6, FIG. 6 shows a configuration of the charge share connections. According to an exemplary embodiment, as shown in FIG. 6, the source driver 20 applies the writing voltages by two dots inversion. The two dots inversion is arranged if the source driver changes the polarity of the writing voltages in every two horizontal periods. Each pair of the data lines comprises a first data line 611 and a second data line 612. The source driver 20 applies the writing voltages so as to make the polarities of the writing voltages in the first data line 611 and the second data line 612 different from each other. Also, the source driver 20 changes the polarities of the first and second data line 611, 612 in each frame. Accordingly, (N−1)th frame 601 and Nth frame 602 have different polarities by a frame inversion as shown in FIG. 6.

Figure 7:
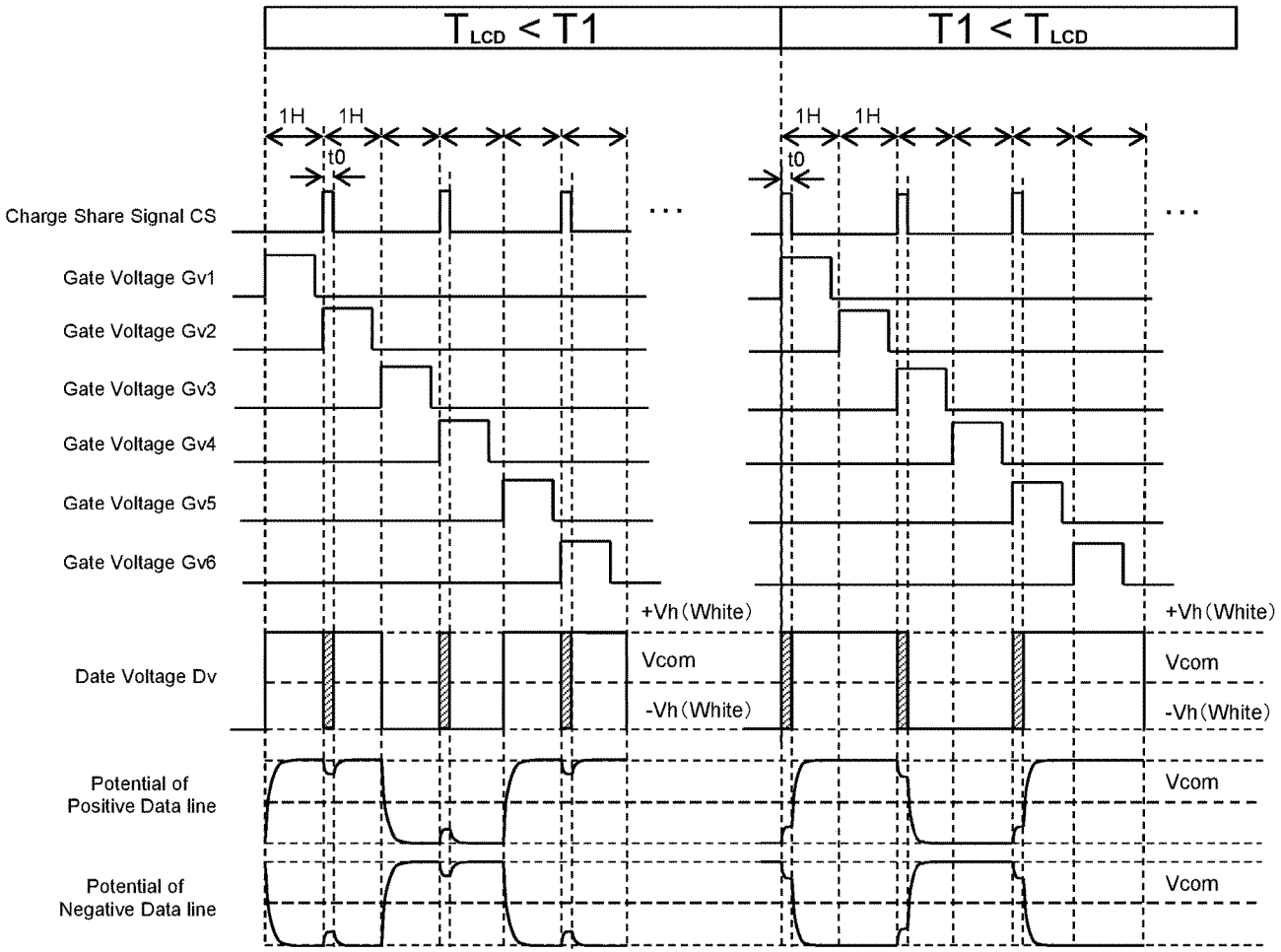
FIG. 7 is a timing chart showing a timing of each signal according to another exemplary embodiment.

Exemplary FIG. 7 shows a timing chart showing timing of each signal according to the exemplary embodiment of the two dots inversion case shown in FIG. 6. As shown in FIG. 7, the temperature range may be divided by a first predetermined temperature (T1). Thus, there are two cases: (i) the temperature is lower than the first predetermined temperature ($T_{LCD}$<T1); and (ii) the temperature is higher than the first temperature (T1<$T_{LCD}$). As shown in FIG. 7, if the temperature ($T_{LCD}$) is lower than the first temperature (T1), the switches 51 are turned on in (m+1)-th horizontal period, where the source driver 20 drives the same polarities of each data line 61 during m-th horizontal period and the (m+1)-th horizontal period.

Referring to FIG. 7, for example, if the temperature ($T_{LCD}$) is lower than the first temperature (T1), the switches 51 are turned on in a second horizontal period (the gate-on signal at Gv2), a fourth horizontal period (Gv4), and a sixth horizontal period (Gv6). For the two dots inversion, the source driver 20 maintains the polarities of all data lines 61 during every two horizontal periods (during the first and second horizontal periods (Gv1 and Gv2), during the third and fourth horizontal periods (Gv3 and Gv4), and during the fifth and sixth horizontal periods (Gv5 and Gv6) in FIG. 7) If the switches 51 are turned on at the beginning of the second horizontal period (Gv2), the fourth horizontal period (Gv4), and the sixth horizontal period (Gv6), the source driver 20 recharges the writing voltages to each data lines 61 after a positively charged line and a negatively charge line share their charge. This increases the burden on the source driver 20. As a result, that is why the source driver 20 emits heat and makes the LCD panel 10 warmer.

Referring still to FIG. 7, on the other hand, the switches 51 are not turned on in (m+2)-th horizontal period, where the source driver 20 changes the polarities of the data line 61 at the transition from the (m+2)-th horizontal period to (m+1)-th horizontal period. For example, the switches 51 are not turned on at the first horizontal period (the gate-on signal at Gv1), the third horizontal period (Gv3), and the fifth horizontal period (Gv5). The source driver 20 changes the polarities of each data line 61 at the transition from the second horizontal period (Gv2) to the third horizontal period (Gv3), from in the fourth horizontal period (Gv4) to the fifth horizontal period (Gv5), and from in the sixth horizontal period (Gv6) to the seventh horizontal period (not shown). The source driver applies the writing voltages to each data line 61 at the beginning of the third horizontal period (Gv3), the fifth horizontal period (Gv5), and the seventh horizontal period (not shown) without an operation of charge share. It also causes to gain some burden on the source driver 20. That is also why the source driver 20 emits heat and makes the LCD panel 10 warmer.

Referring still to FIG. 7, if the temperature ($T_{LCD}$) is higher than the first temperature (T1), the switches 51 are turned on in (m+1)-th horizontal period, where the source driver 20 changes the polarities of the data line 61 at the transition from the (m+1)-th horizontal period to the m-th horizontal period. For example, the switches 51 are turned on at the first horizontal period (the gate-on signal at Gv1), the third horizontal period (Gv3), the fifth horizontal period (Gv5). The source driver applies the writing voltages to the data lines 61 after the first data line 611 and the second data line 612 share their charge, which can reduce an electrical consumption, so the LCD panel 10 may be less heated.

On the other hand, the switches 51 are not turned on in (m+1)-th horizontal period, where the source driver 20 changes the polarities of the data line 61 at the transition from the (m+2)-th horizontal period to the (m+1)-th horizontal period. For example, the switches 51 are not turned on at the second horizontal period (Gv2), the fourth horizontal period (Gv4), and the sixth horizontal period (Gv6). The source driver 20 maintains the polarities of the data line 61 during every two horizontal periods (during the first and second horizontal periods (Gv1 and Gv2), during the third and fourth horizontal periods (Gv3 and Gv4), and during the fifth and sixth horizontal periods (Gv5 and Gv6) in FIG. 7) without an operation of charge share, which does not consume extra electricity.

According to another exemplary embodiment, there may be many alternative variations. According to the heating principles which are described above, for example, even though the temperature ($T_{LCD}$) is higher than the first temperature (T1), the charge share may be operated, but it is not necessary to operate the charge share. Also, if the temperature ($T_{LCD}$) is higher than the first temperature (T1) and lower than the second temperature (T2), the charge share may not be operated. Additionally, if the temperature ($T_{LCD}$) is higher than the second temperature (T2), the charge share may be operated.

The foregoing description and accompanying figures illustrate the principles, preferred embodiments and modes of operation of the invention. However, the invention should not be construed as being limited to the particular embodiments discussed above. Additional variations of the embodiments discussed above will be appreciated by those skilled in the art (for example, features associated with certain configurations of the invention may instead be associated with any other configurations of the invention, as desired).

Therefore, the above-described embodiments should be regarded as illustrative rather than restrictive. Accordingly, it should be appreciated that variations to those embodiments can be made by those skilled in the art without departing from the scope of the invention as defined by the following claims.

What is claimed is:

1. A liquid crystal display (LCD) apparatus comprising:
- a source driver;
- a plurality of data lines electrically connected to the source driver;
- a plurality of switches;
- a plurality of connecting lines;
- a charge share line connecting the plurality of switches;
- a charge share connecting signal emitter that turns the plurality of switches on or off via the charge share line; and
- a thermal sensor that is secured to the LCD apparatus and detects a temperature,
  - wherein each data line of the plurality of data lines electrically connects to at least one of an LCD pixel among a plurality of LCD pixels,
  - wherein each connecting line of the plurality of connecting lines electrically connects at least two corresponding data lines and each connecting line is switched on or off by each switch of the plurality of switches,
- wherein, when the thermal sensor detects that the temperature is lower than the first predetermined temperature, the charge share connecting signal emitter turns on each switch of the plurality of switches during a first period in each horizontal period, and
- wherein, when the thermal sensor detects that the temperature is higher than the first predetermined temperature, the charge share connecting signal emitter turns on each switch of the plurality of switches during a second period in each horizontal period, the second period being shorter than the first period.

2. The apparatus of claim 1, wherein each pair of the data lines comprises a first data line and a second data line, the source driver inputs the writing voltage to the first data line and the second data line, and polarities of the writing voltages in the first data line and the second data line are different from each other.

3. The apparatus of claim 1, wherein, when the thermal sensor detects that the LCD temperature is lower than the first predetermined temperature, the source driver inputs a white writing voltage corresponding to a white image to the plurality of data lines when the LCD is normally a black type irrespective of an external input image data, and the source driver inputs a black writing voltage corresponding to a black image to the plurality of data lines when the LCD is normally a white type irrespective of an external input image data.

4. The apparatus of claim 3, wherein the source driver inputs at least one of the white writing voltage and the black writing voltage until the thermal sensor detects that the temperature is higher than the first predetermined temperature.

5. The apparatus of claim 1, wherein the source driver inputs a writing voltage to the plurality of data lines by column inversion.

6. A method for driving a liquid crystal display (LCD) comprising:
- inputting, by a source driver, a writing voltage to a plurality of LCD pixels via a plurality of data lines by column inversion:
- detecting, by a thermal sensor secured to the LCD, an temperature; and turning on, during a first period in a horizontal period by a charge share connecting signal emitter, a plurality of switches via a charge share line when the thermal sensor detects that the temperature is lower than a first predetermined temperature, and turning on, during a second period in a horizontal period by the charge share connecting signal emitter, the plurality of switches via the charge share line when the thermal sensor detects that the temperature is higher than a first predetermined temperature, the second period being shorter than the first period, wherein the charge share line electrically connects the plurality of switches, and wherein each connecting line of a plurality of connecting lines electrically connects at least two corresponding data lines and each connecting line is switched on or off by the each switch of the plurality of switches.

7. The method of claim 6, further comprising, when inputting the writing voltage, the source driver inputs different polarities of the writing voltages to a first data line and a second data line of each pair of the data lines.

8. A liquid crystal display (LCD) apparatus comprising:

a source driver;

a plurality of data lines electrically connected to the source driver;

a plurality of switches;

a plurality of connecting lines;

a charge share line connecting the plurality of switches;

a charge share connecting signal emitter that turns the plurality of switches on or off via the charge share line; and a thermal sensor that is secured to the LCD apparatus and detects a temperature, wherein each data line of the plurality of data lines electrically connects to at least one of an LCD pixel among a plurality of LCD pixels, wherein each connecting line of the plurality of connecting lines electrically connects at least two corresponding data lines and each connecting line is switched on or off by each switch of the plurality of switches, wherein, when the thermal sensor detects that the temperature is lower than the first predetermined temperature, the charge share connecting signal emitter turns on the plurality of switches m times in one frame, when the thermal sensor detects that the temperature is higher than the first predetermined temperature, the charge share connecting signal emitter turns on the plurality of switches n times in one frame, where n and m are integer and n is less than m.

9. The apparatus of claim 8, wherein each pair of the data lines comprises a first data line and a second data line, the source driver inputs the writing voltage to the first data line and the second data line, and polarities of the writing voltages in the first data line and the second data line are different from each other.

10. The apparatus of claim 8, wherein, when the thermal sensor detects that the LCD temperature is lower than the first predetermined temperature, the source driver inputs a white writing voltage corresponding to a white image to the plurality of data lines when the LCD is normally a black type irrespective of an external input image data, and the source driver inputs a black writing voltage corresponding to a black image to the plurality of data lines when the LCD is normally a white type irrespective of an external input image data.

11. The apparatus of claim 10, wherein the source driver inputs at least one of the white writing voltage and the black writing voltage until the thermal sensor detects that the temperature is higher than the first predetermined temperature.

12. The apparatus of claim 8, wherein the source driver inputs a writing voltage to the plurality of data lines by column inversion.

* * * * *